US011039670B2

(12) United States Patent
Carlson et al.

(10) Patent No.: US 11,039,670 B2
(45) Date of Patent: Jun. 22, 2021

(54) NECKLACE STORAGE ASSEMBLY

(71) Applicants: Stephanie Carlson, Clearwater, KS (US); Stacia Pieroni, Lee's Summit, MO (US)

(72) Inventors: Stephanie Carlson, Clearwater, KS (US); Stacia Pieroni, Lee's Summit, MO (US)

( * ) Notice: Subject to any disclaimer, the term of this patent is extended or adjusted under 35 U.S.C. 154(b) by 150 days.

(21) Appl. No.: 16/269,765

(22) Filed: Feb. 7, 2019

(65) Prior Publication Data

US 2019/0166966 A1 Jun. 6, 2019

(51) Int. Cl.
*A45C 11/16* (2006.01)
*A47F 7/02* (2006.01)

(52) U.S. Cl.
CPC ..... *A45C 11/16* (2013.01); *A47F 7/02* (2013.01)

(58) Field of Classification Search
CPC ..... A45C 11/16; A47F 7/02
USPC ..... 206/6.1
See application file for complete search history.

(56) References Cited

U.S. PATENT DOCUMENTS 5,109,803 A * 5/1992 Dunham ..... A01K 27/007 119/654
5,211,284 A * 5/1993 Parks ..... A45C 11/16 206/348
5,971,612 A 10/1999 McAuslan
6,023,786 A 2/2000 Burnett
6,740,818 B2 * 5/2004 Clark ..... H02G 3/0481 174/135
8,424,341 B2 4/2013 Summerford
8,502,069 B2 * 8/2013 Holland ..... H02G 15/18 174/36
D699,404 S 2/2014 Bobka-Cradduck
8,668,080 B1 * 3/2014 Kazanchyan ..... A45C 11/16 206/6.1
D734,037 S 7/2015 Coon
9,078,499 B1 * 7/2015 Brabec ..... A45C 11/16
9,472,930 B2 10/2016 Lake-Maiorana
(Continued)

FOREIGN PATENT DOCUMENTS

JP 2007151054 6/2007
JP 201487038 5/2014
(Continued)

OTHER PUBLICATIONS snageze.com; How to stop a Necklace from Catching your Hair; May 31, 2015.
thriftyfun.com; Straw Pendant Necklace Holder; Sep. 20, 2016.

*Primary Examiner* — Steven A. Reynolds
(74) *Attorney, Agent, or Firm* — Kenneth H. Jack; Davis & Jack, L.L.C.

(57) ABSTRACT

An assembly for storing a necklace, the assembly incorporating a flexible tube having an end, an opposite end, and a hollow bore; the assembly further incorporating first and second ports respectively opening the hollow bore at the flexible tube's end and opposite end; the assembly further incorporating a first tie having proximal and distal ends, the first tie's proximal end being fixedly attached to or formed wholly with the flexible tube's opposite end; the assembly further incorporating a first fastener having a pair of halves wherein one of the halves is fixedly attached to the first tie's distal end, and wherein another of the halves is fixedly attached to the flexible tube's opposite end.

10 Claims, 7 Drawing Sheets

(56) References Cited

U.S. PATENT DOCUMENTS

| | | | | |
|---|---|---|---|---|
| 2010/0236287 | A1* | 9/2010 | Summerford | A44C 15/005 63/1.12 |
| 2014/0090417 | A1* | 4/2014 | Summerford | A44C 15/005 63/3 |
| 2015/0264493 | A1 | 9/2015 | Jung | |
| 2017/0095047 | A1* | 4/2017 | Kim | B65D 31/12 |

FOREIGN PATENT DOCUMENTS

| | | | |
|---|---|---|---|
| KR | 20130069258 | | 6/2013 |
| WO | WO2016170156 | A1 | 10/2016 |

* cited by examiner

NECKLACE STORAGE ASSEMBLY

FIELD OF THE INVENTION

This invention relates to apparatus and assemblies for containing and storing jewelry. More particularly, this invention relates to such apparatus and assemblies which are specially adapted for storing necklaces.

BACKGROUND OF THE INVENTION

Chain necklace and pendant combinations are commonly stored and displayed for selection via hanging from jewelry suspension hooks within a jewelry case. Several jewelry hooks may be provided within a large jewelry case for vertically organized and hanging suspension of a collection of such necklaces. In use, an owner of the collection of necklaces so hung and displayed may select and retrieve a single necklace from its jewelry case hook. Thereafter, the owner may don the necklace, wearing it about his or her neck.

Following necklace wearing, the owner may remove the necklace and return it to its jewelry case hook for continued storage alongside other necklaces displayed within the jewelry case. Utilization of such jewelry case necklace suspension hooks advantageously allows the selected necklace to be either actively worn or hung in an organized and untangled fashion along with several other necklaces stored within the owner's jewelry case.

In the event that such necklace collection owner desires to pack a selection of such necklaces for travel away from home, the owner may remove multiple necklaces from the above described jewelry hooks and may place the selected necklaces within a travel case. Upon doing so, such necklaces commonly become undesirably tangled and intertwined together.

The instant inventive assembly for storing a necklace solves or ameliorates the above described necklace related problems and difficulties by providing specially configured flexible tubes which are capable of easily and conveniently storing and protecting necklaces within a travel case while preventing any tangling or intertwining of the necklaces.

BRIEF SUMMARY OF THE INVENTION

A first structural component of the instant inventive assembly for storing a necklace comprises a flexible tube having a chain insertion end, an opposite end, and having a hollow bore extending therebetween. In a preferred embodiment, the flexible tube has first and second ports or end openings, such ports respectively opening the hollow bore at the flexible tube's chain insertion end and opposite end. In the preferred embodiment, the flexible tube is composed of a sheet of flexible fabric which is folded or looped into a tubular configuration. Mating edges of the looped sheet are preferably joined at a sewn seam.

A further structural component of the instant inventive assembly comprises a first tie having proximal and distal ends, said tie's proximal end being fixedly attached to or formed wholly with the flexible tube's opposite end.

A further structural component of the instant inventive assembly comprises a first fastener which is preferably of the type incorporating a pair of fastener halves. In the preferred embodiment, one of the halves of such first fastener is fixedly attached to the distal end of the first tie, and the other fastener half is fixedly attached to a wall surface at the flexible tube's opposite end.

In use of the instant inventive assembly, a user may grasp the flexible tube, and may orient it so that the first port at the tube's insertion end opens upwardly. Thereafter, the user may grasp a pendant and chain necklace combination by its pendant so that the chain hangs vertically downward. Thereafter, the user may position the downwardly extending chain directly over the upwardly opening first port. Thereafter, the user may downwardly lower the chain through the hollow bore of the tube until the lower end of the chain emerges from the second port at the tube's opposite end.

Thereafter, the assembly's first tie component may be manually extended through the chain at its exposed lower end. Thereafter, the one of the first fastener's halves which is attached to the distal end of the first tie may be engaged with and fastened against such fastener's other half. Such tie extending and fastening actions advantageously secure the distal end of the first tie to a side wall of the flexible tube so that such tie effectively holds the looped lower end of the chain at the opposite end of the flexible tube. Provided that the pendant which is attached to the necklace is sufficiently large, the pendant itself may simultaneously lock the opposite end of the chain at the flexible tube's insertion end.

Multiple chain and pendant combinations stored separately within multiple renditions of the instant inventive assembly may be conveniently packed together within a travel case without any intertwining or tangling of chains.

Accordingly, objects of the instant invention include the provision of an assembly for storing a necklace which incorporates structures as described above, and which arranges those structures in relation to each other in manners described above for the achievement of functional benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
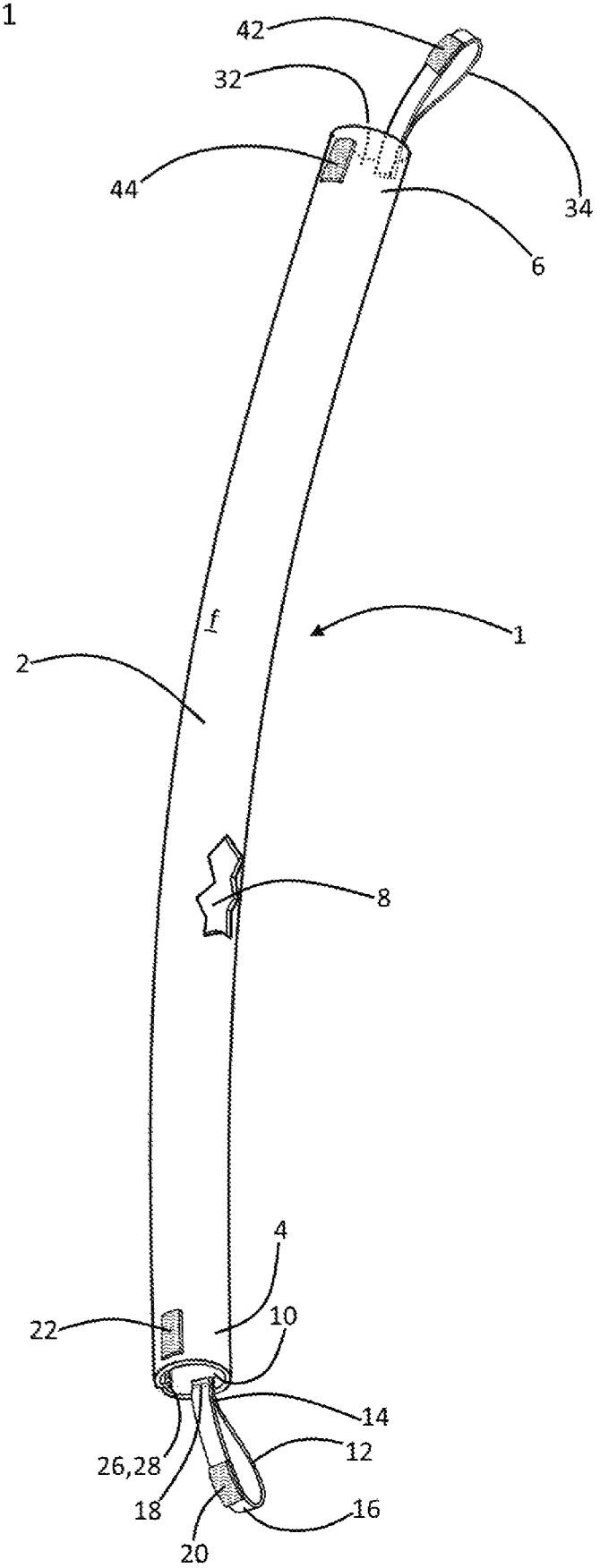
FIG. 1 is a perspective view of a preferred embodiment of the instant inventive assembly for storing a necklace.

Referring now to the drawings, and in particular to Drawing FIG. 1, a preferred embodiment of the instant inventive assembly for storing a necklace is referred to generally by Reference Arrow 1. The assembly 1 comprises a flexible tube 2 which has a chain insertion end 4 and an opposite end 6.

Figure 2:
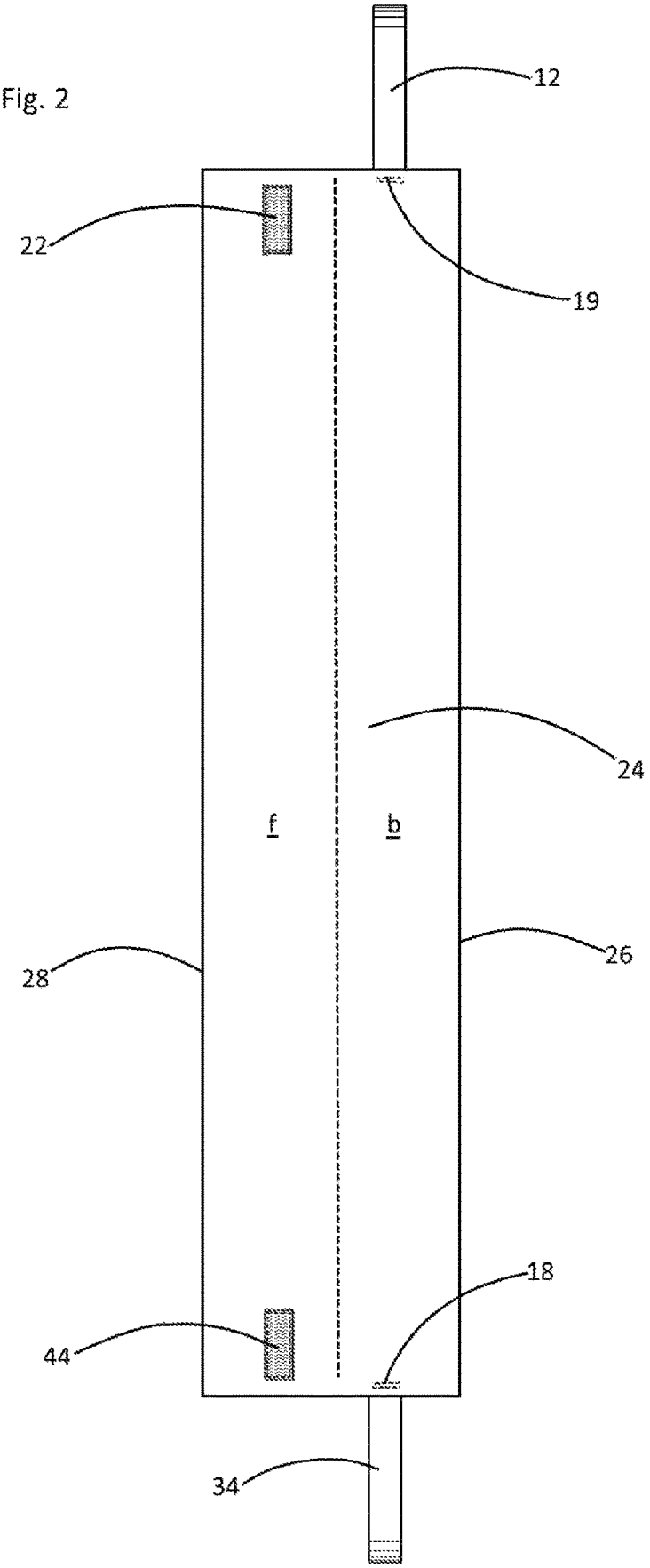
FIG. 2 is an inverted view of partially assembled components of the FIG. 1 structure.
Figure 3:
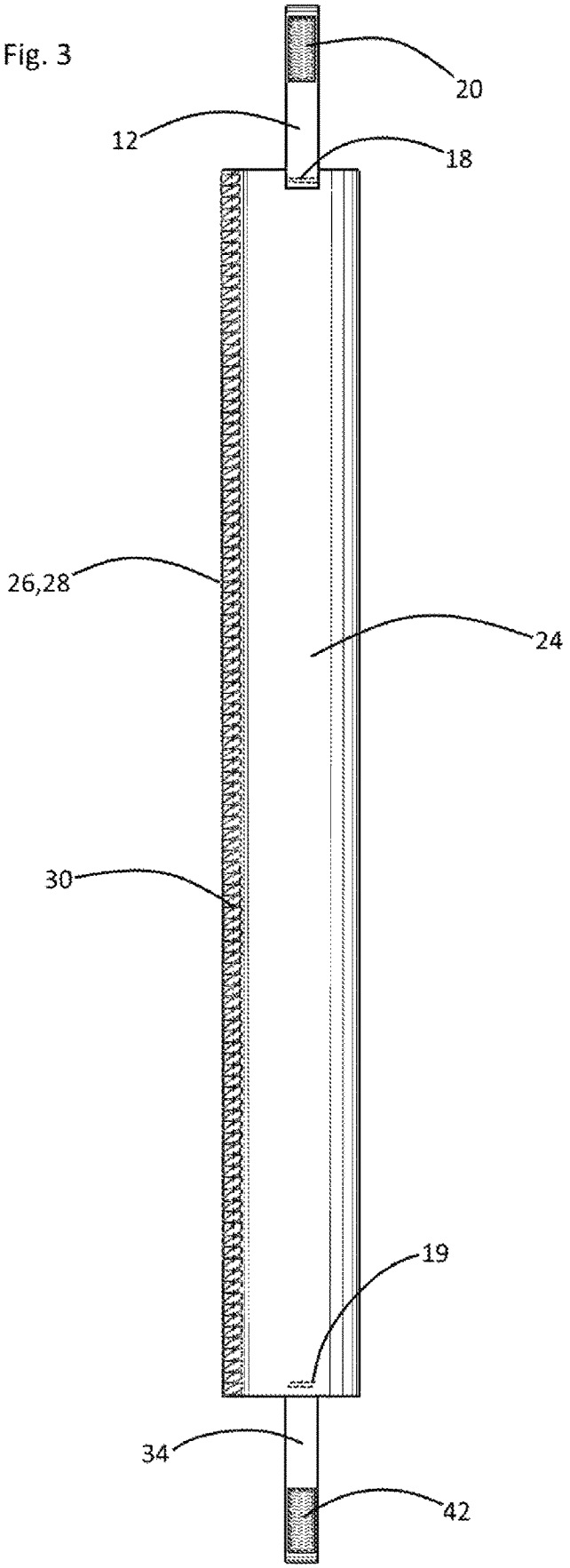
FIG. 3 redepicts the structure of FIG. 2, the view of FIG. 3 demonstrating lateral overfolding and seam sewing assembly steps.

Referring further simultaneously to FIGS. 2 and 3, the flexible tube 2 preferably comprises a vertically oblongated fabric sheet 24 having a pair of lateral edges 26 and 28. Upon a leftward folding of the sheet 24 from the FIG. 2 configuration to the FIG. 3 configuration, edge 26 overlies and abuts edge 28, as depicted in FIG. 3. Edge incapsulating serger machine applied overlock stitching 30 may be sewn therealong to securely configure the sheet 24 in its initial tubular configuration. Upon an obversion of the tubularly sewn sheet 24 of FIG. 3 to assume the FIG. 1 configuration, a hollow chain encapsulating bore 8 is formed. The preferably utilized serger machine stitch 30 advantageously prevents threads of the woven sheet 24 at edges 26 and 28 from falling or straying into the hollow bore 8.

Figure 7:
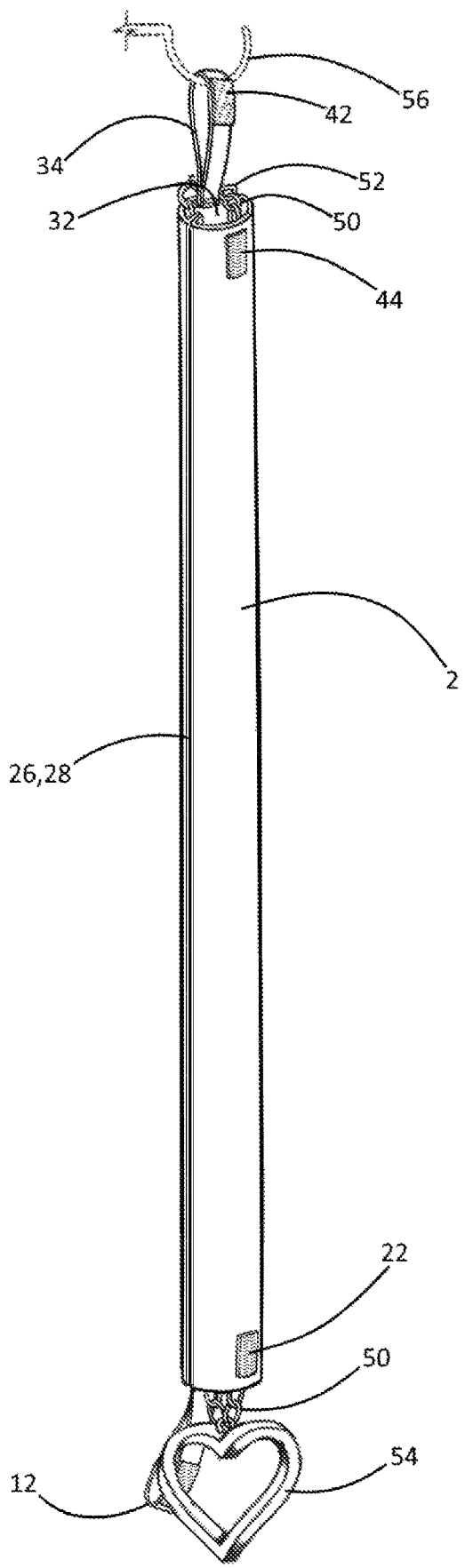
FIG. 7 presents and alternate configuration of the structure of FIG. 6, the view of FIG. 7 showing the completed chain and tube assembly suspended from a jewelry hook.

Referring simultaneously to FIGS. 1-4, the chain receiving end 4 and the opposite end 6 of the flexible tube 2 respectively define first and second ports 10 and 32, such ports opening the hollow bore 8 at its opposite ends. At least a first tie 34 is fixedly attached to the flexible tube 2, such tie's attachment preferably being positioned at the tube's opposite end 6. Such attachment preferably secures a proximal end 36 of the tie 34 at the back side [b] of the tube, and such attachment is preferably effected via stitching 18. Suitably, the at least first tie 34 may be alternatively formed wholly with or cut as an integral extension from the opposite end 6 of the flexible tube 2. Referring further simultaneously to FIG. 7, the first tie 34 is preferably configured as a loop so that the tie's distal end 38 may serve as a hook engaging member.

Figure 4:
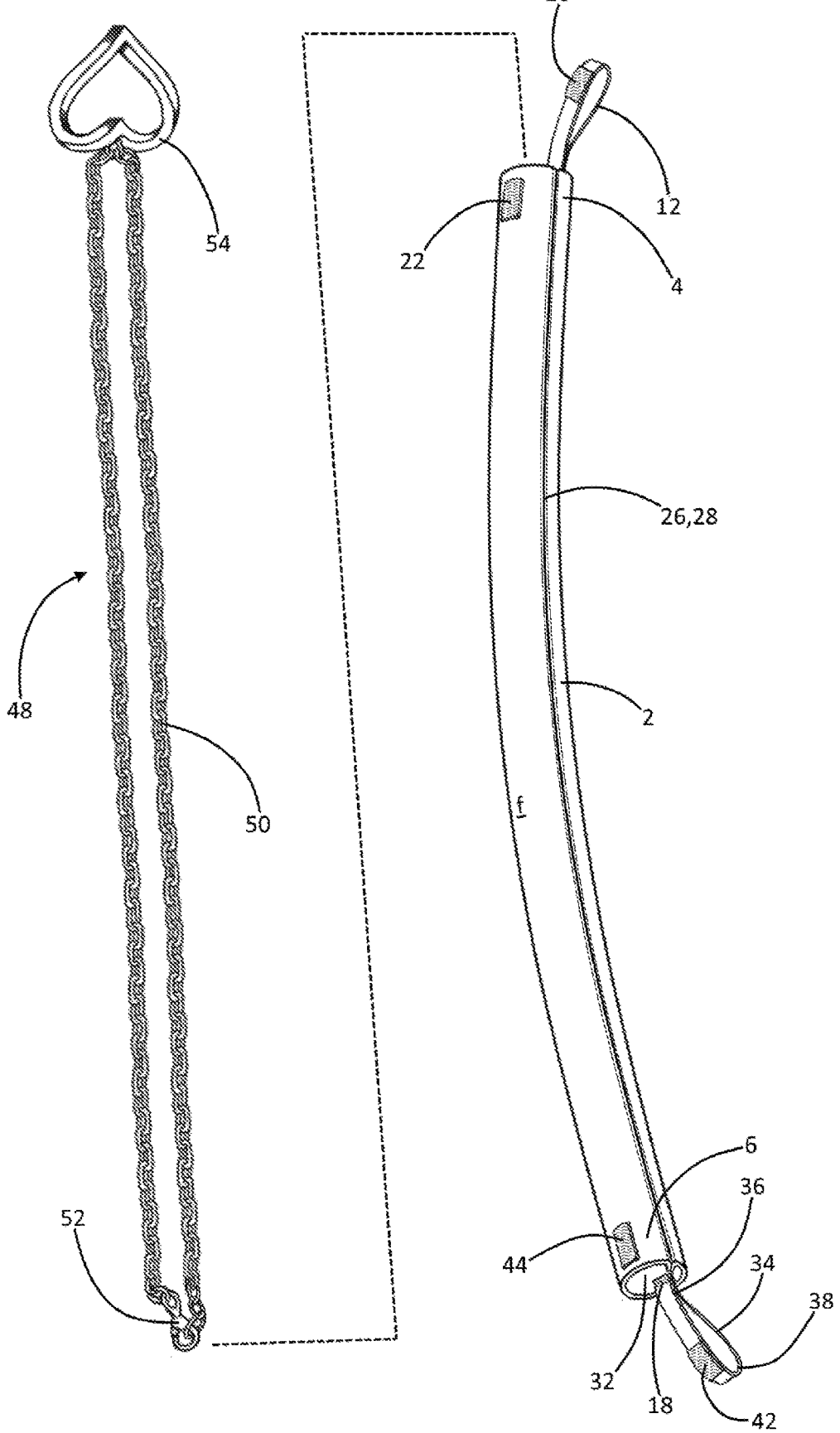
FIG. 4 is an obverted, inverted, and rotated view of the FIG. 3 structure, the view of FIG. 4 further showing a necklace whose chain may be received within said structure's hollow bore.

A further structural component of the instant inventive assembly comprises a first fastener which preferably is of the type which incorporates a pair of fastener halves. In the preferred embodiment, one of the halves of the first fastener is fixedly attached to a distal end of the first tie, the other fastener half being fixedly attached at the flexible tube's opposite end 6, preferably at a front side f of such tube. In the example of FIG. 4, a "Velcro" flexible hook pad 42 is mounted to the distal end 38 of the first tie 34, and a "Velcro" loop pad 44 is correspondingly fixedly attached to the tube's opposite end 6 at its front side f. Upon engagement of flexible hook pad 42 with flexible loop pad 44 in the FIG. 6 configuration, the tie 34 advantageously forms a chain engaging bridge 35 across the second port 32. The flexible hook pad 42 and flexible loop pad 44 first fastener combination is considered as being representative of other suitably substituted and utilized fasteners having paired halves including button loop and button fasteners, button eye and button fasteners, hook and eye fasteners, hook and slot fasteners, snap fasteners, magnetic fasteners, and adhesive fasteners.

Figure 5:
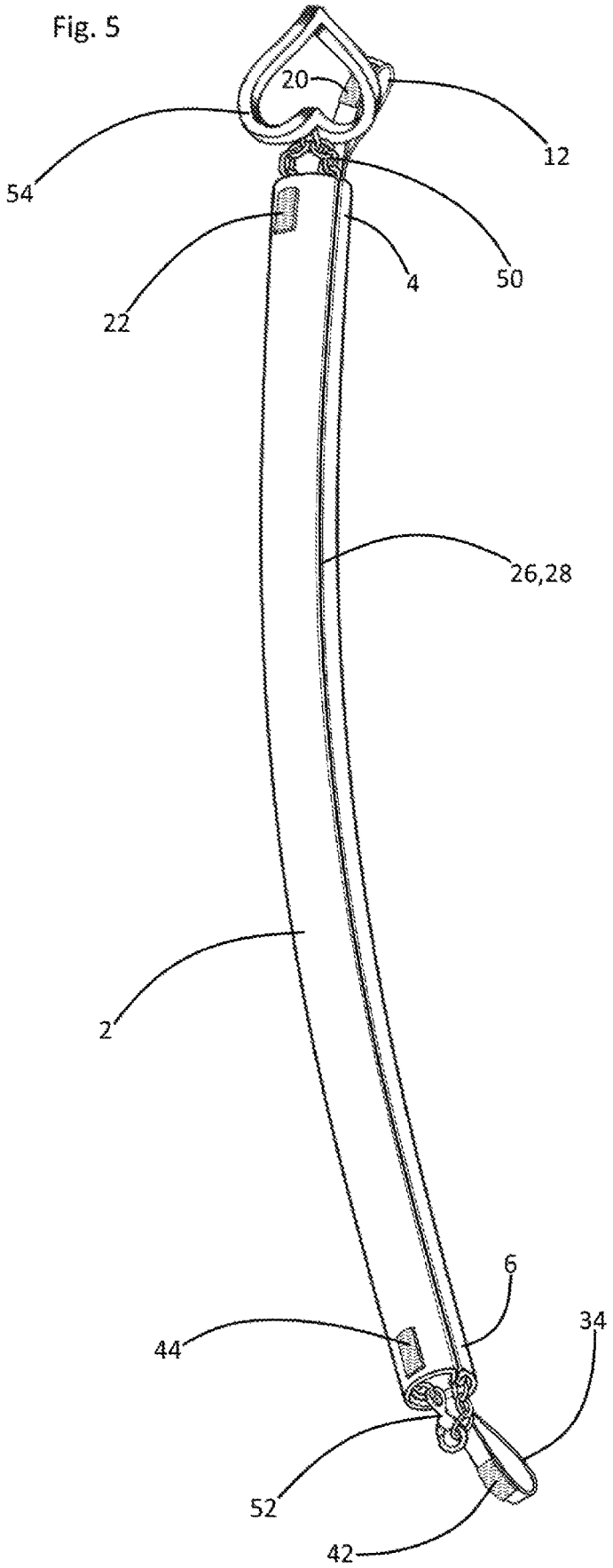
FIG. 5 redepicts the structure of FIG. 4, the view of FIG. 5 showing the necklace's chain received within said hollow bore.

In use of the instant inventive assembly, referring to FIGS. 1-5, a user or operator may grasp the flexible tube 2 in one hand, and may orient such tube so that its first port 10 opens upwardly as indicated in FIG. 4. Thereafter, such operator may grasp with the other hand a necklace in the form of a pendant and chain combination, such necklace being referred to generally by Reference Arrow 48. Holding such necklace 48, the operator may align the pendant 54 and the chain 50 so that the chain hangs downwardly toward the tube 2. Thereafter, the operator may further align the pendant and chain combination so that the lower end clasp 52 of the chain 50 directly overlies the first port 10. Thereafter, the operator may lower the chain 50 downwardly through the hollow bore 8 of the flexible tube 2 until the lower clasp 52 emerges from the second port 32 as indicated in FIG. 5.

Figure 6:
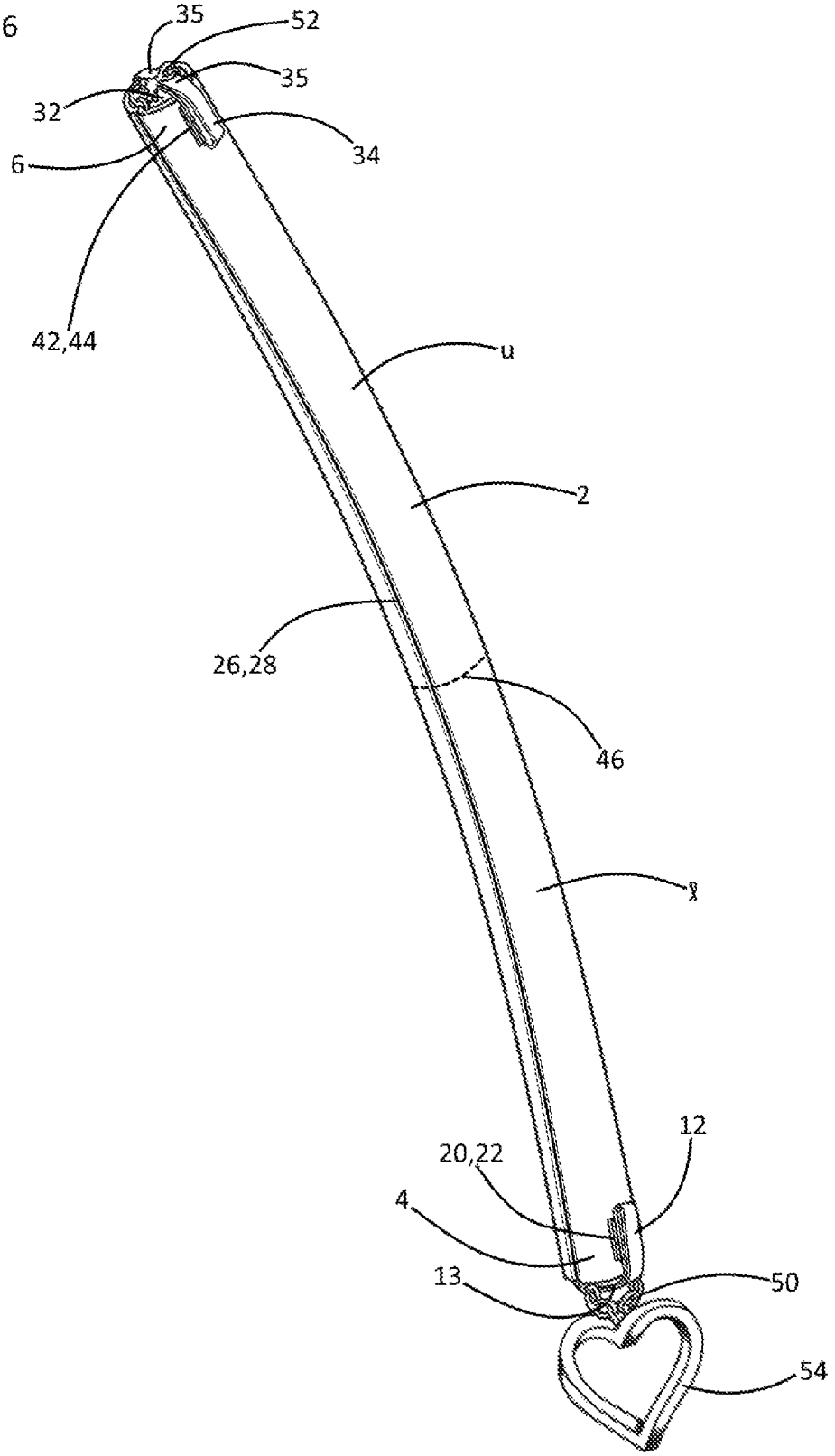
FIG. 6 redepicts the structure of FIG. 5, the view of FIG. 6 showing such structure inverted and showing attached insertion end and opposite end ties extended in port bridging and chain engaging configurations.

Thereafter, the operator may tactilely manipulate the clasped chain end 52 and the tie 34, causing such tie to extend beneath the looped clasp 52, as shown in FIG. 6. Such extension of the tie 34 advantageously forms the bridge 35 which spans the second port 32. Thereafter, flexible hook pad 42 may be engaged with loop pad 44.

Provided that pendant 54 is larger than the first port 10, the pendant may itself lock the opposite end of the chain at the tube's chain receiving end 4. Such pendant actuated locking of the chain 50 in combination with the locking action of the bridge 35 at the clasp end of the chain may securely hold the entire length of the chain 50 within bore 8. Accordingly, the instant inventive assembly holds and protects the necklace chain 50 within hollow bore 8, advantageously preventing such chain from tangling with other necklace chains.

Several renditions of the flexible tube assembly 2 may be provided for holding and storing multiple pendant and chain combinations. To accommodate varying necklace chain lengths, such multiple renditions of the invention's flexible tube may have corresponding varying tube lengths. Where multiple pendant and chain combinations are held and stored within such multiple renditions of the instant invention's flexible tube assembly, such held and stored necklaces may be conveniently packed within a travel case (not depicted within views) in close proximity with each other tube encapsuled chains without intertwining and tangling of chains.

To accommodate for pendants which are small enough to pass through the first port 10 at the chain insertion end 4 of the flexible tube 2, a second tie 12 is preferably provided, such second tie preferably being configured similarly with the first tie 34, the second tie having proximal and distal ends 14 and 16 and having a stitched proximal end attachment 19 positioning the tie at the back side b of the chain receiving end 4 of the flexible tube 2. A second fastener incorporating paired fastener halves, suitably comprising a second "Velcro" flexible hook pad half 20 and a second "Velcro" loop pad half 22, is attached to tie 12 and to end 4 in a fashion mirroring the opposite end attachments of "Velcro" flexible hook pad 42 and "Velcro" loop pad 44. As with such first "Velcro" flexible hook pad and loop pad fastener 42,44, the second "Velcro" fastener 20,22 supported at the tube's chain insertion end 4 is intended as being representative of second releasable connectors selected from button loop and button fasteners, button eye and button fasteners, hook and eye fasteners, hook and slot fasteners, snap fasteners, magnetic fasteners, and adhesive fasteners.

Referring in particular to FIG. 6, upon an extension of the second tie 12 across the first port 10 and through chain 50, a second bridge 13 is advantageously formed, such bridge securing the pendant end of the chain 50 within the bore 8 of the flexible tube 2. The second bridge 13 advantageously retains the chain 50 regardless of whether pendant 54 is large enough to lock against the peripheral edge of port 10. Accordingly, the assembly's provision of the second tie 12 and second fastener 20,22 structures lends versatility to the assembly, allowing it to hold and store chains having both large and small pendants, or no pendant at all.

Dashed line 46 drawn upon the flexible tube 2 of FIG. 6 denotes a preferred mirroring vertical division of the assembly into upper and lower halves u and L. In such preferred configuration, structures at the chain insertion end 4 of the flexible tube 2 substantially structurally mirror those at the opposite end 6. Such preferred mirroring end to end structural configuration of the tube 2 advantageously allows a user to slidably insert necklace chain 50 from either end or from either direction, and allows utilization of ties 12 and 34 to secure either end of the chain 50 within the hollow bore 8.

At the end of a trip, the user of the instant inventive assembly may find several renditions of the complete FIG. 6 assembly stored without tangling or intertwining within his or her suitcase. Upon unpacking, the user may wish to return each of the tube encapsuled pendant and chain combinations to hooks within his or her jewelry case. In order to do so, the user may simply and conveniently detach each of the opposite end 6 "Velcro" hook pads 42 from their "Velcro" loop pads 44, and may upwardly extend the first ties 34. Thereafter, the user may engage each first tie 34 with one of the suspension hooks 56 which are mounted within the user's jewelry case. To facilitate such jewelry hook engagements and suspensions, the ties 12 and 34 are preferably configured as loops which are composed of woven strapping or ribbon. In the FIG. 7 mode of use of the inventive assembly, multiple renditions of the assembly may conveniently hang in a tangle free and organized fashion from multiple jewelry hooks 56.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. An assembly for storing a necklace, the assembly comprising:

(a) a flexible tube having an end, an opposite end, and a hollow bore;

(b) first and second ports respectively opening the hollow bore at the flexible tube's end and opposite end;

(c) a first tie having proximal and distal ends, said tie's proximal end being fixedly attached to or formed wholly with the flexible tube's opposite end;

(d) a first fastener comprising a pair of halves, one of said fastener's halves being fixedly attached to the first tie's distal end, and another of said fastener's halves being fixedly attached tothe flexible tube's opposite end, wherein the distal end of the flexible tie comprises a hook engaging loop; wherein the first fastener comprises a releasable connector selected from the group consisting of flexible hook pad and loop pad fasteners, button loop and button fasteners, button eye and button fasteners, hook and eye fasteners, hook and slot fasteners, snap fasteners, magnetic fasteners, and adhesive fasteners;

(e) a second tie having proximal and distal ends, said tie's proximal end being fixedly attached to or formed wholly with the flexible tube's end; and (f) wherein the flexible tube comprises a sheet having a pair of edges joined at a seam.

2. The assembly of claim 1 further comprising a second fastener comprising a second pair of halves, one of the halves among said second pair of halves being fixedly attached to the second tie's distal end, and another of the halves among said second pair of halves being fixedly attached to the flexible tube's end.

3. The assembly of claim 2 wherein the second fastener comprises a second releasable connector selected from the group consisting of flexible hook pad and loop pad fasteners, button loop and button fasteners, button eye and button fasteners, hook and eye fasteners, hook and slot fasteners, snap fasteners, magnetic fasteners, and adhesive fasteners.

4. The assembly of claim 3 wherein the flexible tube has a back side and a front side, wherein the fixed attachments of the proximal ends of the second and first ties respectively to said tube's end and opposite end are positioned at said tube's back side, and wherein said fasteners' other halves are positioned at said tube's front side.

5. The assembly of claim 4 wherein, upon fastenings of the first and second fasteners, the first and second ties respectively bridge the second and first ports.

6. The assembly of claim 5 wherein the first tie comprises a suspension loop.

7. The assembly of claim 6 wherein the second tie comprises a second suspension loop.

8. The assembly of claim 7 wherein the flexible tube, the first and second ties, and the first and second fasteners comprise a tube, ties, and fasteners combination, wherein said combination has upper and lower ends, and wherein said combination's upper end mirrors said combination's lower end.

9. The assembly of claim 8 further comprising serger machine applied overlock stitching, said stitching extending along the seam.

10. The assembly of claim 9 wherein the sheet comprises woven fabric.

* * * * *